US010220642B2

(12) United States Patent
Igarashi et al.

(10) Patent No.: US 10,220,642 B2
(45) **Date of Patent: *Mar. 5, 2019**

(54) ROLL SHEET CONVEYING APPARATUS AND SHEET CONVEYING CONTROL METHOD

(71) Applicant: CANON KABUSHIKI KAISHA, Tokyo (JP)

(72) Inventors: Yuki Igarashi, Tokyo (JP); Ryoya Shinjo, Kawasaki (JP); Haruhiko Tanami, Fuchu (JP); Ryohei Maruyama, Kawasaki (JP); Shin Genta, Yokohama (JP); Naoki Wakayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

This patent is subject to a terminal disclaimer.

(21) Appl. No.: 15/082,390

(22) Filed: Mar. 28, 2016

(65) Prior Publication Data

US 2016/0207333 A1 Jul. 21, 2016

Related U.S. Application Data

(62) Division of application No. 14/172,086, filed on Feb. 4, 2014, now Pat. No. 9,334,137.

(30) Foreign Application Priority Data

Feb. 22, 2013 (JP) ..... 2013-033411

(51) Int. Cl.
*B41J 13/00* (2006.01)
*B65H 23/182* (2006.01)
(Continued)

(52) U.S. Cl.
CPC ..... *B41J 13/0009* (2013.01); *B65H 23/185* (2013.01); *B65H 23/1825* (2013.01);
(Continued)

(58) Field of Classification Search
CPC .. B41J 13/0009; B65H 23/063; B65H 23/185; B65H 23/192; B65H 23/1825; B65H 23/1888
See application file for complete search history.

(56) References Cited

U.S. PATENT DOCUMENTS 8,864,059 B2 * 10/2014 Hatada ..... B65H 19/10 242/419.2
8,998,368 B2 * 4/2015 Igarashi ..... B41J 15/04 347/104
(Continued)

FOREIGN PATENT DOCUMENTS

JP 05-177084 7/1993
JP 2007-245544 A 9/2007
(Continued)

*Primary Examiner* — Sang K Kim
(74) *Attorney, Agent, or Firm* — Venable LLP

(57) ABSTRACT

A print apparatus has a supporting section for supporting a roll of a continuous sheet, a driving mechanism having a motor for rotating the roll supported by the supporting section, a detection unit configured to detect a rotation state of the roll supported by the supporting section, a conveyance roller for conveying the continuous sheet drawn out from the roll and a print unit configured to form an image on the continuous sheet conveyed by the conveyance roller. A control unit is configured to obtain information indicating a moment of inertia of the roll supported by the supporting section based on detected values of the detection unit and to adjust a driving torque of the motor based on the obtained information, intermittently during printing.

6 Claims, 7 Drawing Sheets

(51) Int. Cl.

| | |
|---|---|
| ***B65H 23/185*** | (2006.01) |
| ***B65H 23/188*** | (2006.01) |
| ***B65H 23/192*** | (2006.01) |
| *B41J 15/16* | (2006.01) |

(52) U.S. Cl.
CPC ..... *B65H 23/1888* (2013.01); *B65H 23/192* (2013.01); *B41J 15/16* (2013.01); *B65H 2301/51256* (2013.01); *B65H 2513/11* (2013.01); *B65H 2515/116* (2013.01); *B65H 2515/32* (2013.01); *B65H 2553/51* (2013.01); *B65H 2601/272* (2013.01); *B65H 2801/09* (2013.01); *B65H 2801/12* (2013.01)

(56) References Cited

U.S. PATENT DOCUMENTS

| | | | | |
|---|---|---|---|---|
| 9,334,137 | B2 * | 5/2016 | Igarashi | B65H 23/1825 |
| 2009/0121423 | A1 | 5/2009 | Nakamura et al. | |
| 2009/0245912 | A1 | 10/2009 | Igarashi et al. | |
| 2009/0269119 | A1 * | 10/2009 | Hatada | B41J 11/001 400/618 |
| 2011/0086842 | A1 * | 4/2011 | Stadtmueller | C07D 239/42 514/211.06 |
| 2011/0180649 | A1 | 7/2011 | Huang et al. | |
| 2012/0012634 | A1 * | 1/2012 | Hatada | B65H 19/10 226/8 |
| 2012/0038699 | A1 * | 2/2012 | Hatada | B41J 11/001 347/16 |
| 2012/0087707 | A1 * | 4/2012 | Igarashi | B41J 11/425 400/611 |
| 2012/0200628 | A1 * | 8/2012 | Igarashi | B41J 11/42 347/16 |
| 2012/0263514 | A1 | 10/2012 | Tanami et al. | |
| 2013/0026283 | A1 * | 1/2013 | Kikuchi | B65H 20/005 242/563 |
| 2014/0239113 | A1 * | 8/2014 | Igarashi | B65H 23/1825 242/420.5 |

FOREIGN PATENT DOCUMENTS

| | | |
|---|---|---|
| JP | 2009-242048 | 10/2009 |
| JP | 2010-052380 A | 3/2010 |
| JP | 2011-178497 A | 9/2011 |

* cited by examiner

ROLL SHEET CONVEYING APPARATUS AND SHEET CONVEYING CONTROL METHOD

BACKGROUND OF THE INVENTION

Field of the Invention

The present invention relates to a roll sheet conveying apparatus which is used for a printer, a facsimile machine, a copying machine, and the like, and which draws out a sheet held in a roll and simultaneously conveys the sheet. More specifically, the present invention relates to a real-time motor control method for keeping constant the tension of a sheet to be conveyed even in a state in which a roll sheet is consumed gradually.

Description of the Related Art

In a roll sheet conveying apparatus for drawing out and conveying a sheet wound in a roll, it is desirable to apply certain tension between the roll sheet and a conveying roller for conveying the roll sheet in order to remove sheet curl and convey the roll sheet without slack or skew.

For example, Japanese Patent Laid-open No. 2009-242048 discloses measuring a load on a roll sheet by performing a preliminary identifying operation (System Identifying Performance) and applying appropriate tension according to a conveying speed. Further, Japanese Patent Laid-open No. H05-177084 (1993) discloses not a conveying apparatus, but a washing machine which preliminarily determines fabric capacity based on load torque obtained from a motor rotation speed and a duty ratio, and which supplies water in an amount suitable for the obtained fabric capacity.

However, the features disclosed in Japanese Patent Laid-open No. 2009-242048 and Japanese Patent Laid-open No. H05-177084 (1993) require an identifying operation for detecting the load on the roll sheet or the fabric capacity at timing different from that of an original operation and consume time and power for the identifying operation. Further, a friction load on the rotation of the roll sheet may vary depending on the remaining amount, type, lot, or use environment of the roll sheet, and drive control based on data obtained by performing the identifying operation does not necessarily function normally during the original operation. More specifically, in order to maintain appropriate tension irrespective of the type of the sheet, use environment the remaining amount of the roll sheet and the like, it is desirable to appropriately control a motor for rotating the roll sheet and the conveying roller during the original operation according to a change in these various conditions.

SUMMARY OF THE INVENTION

The present invention is made to solve the above problem. Accordingly, an object of the present invention is to provide a roll sheet conveying apparatus and a sheet conveying control method wherein it is possible to control motor driving for conveying a roll sheet at appropriate timing to keep constant the tension of the sheet to be conveyed without performing a special identifying operation.

In a first aspect of the present invention, there is provided a sheet conveying apparatus comprising: a supporting section for supporting a roll sheet in which a sheet is wound in a roll; a sheet feeding motor for rotating the roll sheet; a first encoder for detecting a rotation amount of the roll sheet; a conveying roller for conveying a sheet fed from the supporting section; a conveying motor for rotating the conveying roller; and a second encoder for detecting a rotation amount of the conveying roller, wherein the sheet conveying apparatus further comprises: an obtaining unit configured to obtain friction load torque T for rotating the roll sheet based on output current of the sheet feeding motor, output current of the conveying motor, a detected value of the first encoder, and a detected value of the second encoder; a storing unit configured to store friction load information associating the friction load torque T one-to-one with a mass of the roll sheet; a unit configured to derive a default mass m of the roll sheet for the friction load torque T obtained by the obtaining unit by referring to the storing unit; a unit configured to estimate default moment of inertia I of the roll sheet by using the default mass m; and a unit configured to control driving of the sheet feeding motor and the conveying motor based on the default moment of inertia I to keep constant tension of the sheet.

In a second aspect of the present invention, there is provided a conveying control method for a sheet conveying apparatus which conveys a sheet using: a roll sheet which rotates while the sheet is held in a roll; a sheet feeding motor for rotating the roll sheet; a first encoder for detecting a rotation amount of the roll sheet; a conveying roller for conveying the sheet fed from the roll sheet; a conveying motor for rotating the conveying roller; and a second encoder for detecting a rotation amount of the conveying roller, wherein the conveying method comprises: obtaining friction load torque T for rotating the roll sheet based on output current of the sheet feeding motor, output current of the conveying motor, a detected value of the first encoder, and a detected value of the second encoder; deriving a default mass m of the roll sheet for the friction load torque T obtained in the obtaining step by referring to a storing unit configured to store friction load information associating the friction load torque T one-to-one with a mass of the roll sheet; estimating default moment of inertia I of the roll sheet by using the default mass m; and controlling driving of the sheet feeding motor and the conveying motor based on the default moment of inertia I to keep constant tension of the sheet.

In a third aspect of the present invention, there is provided a sheet conveying apparatus comprising: a supporting section for supporting a roll of a continuous sheet; a driving mechanism for rotating the roll supported in the supporting section, the driving mechanism including a motor; a detecting unit configured to detect a rotation state of the roll supported in the supporting section; a roller for conveying the continuous sheet drawn out from the roll; a calculating unit configured to calculate moment of inertia of the roll based on driving current of the motor and a detected value of the detecting unit; and a controlling unit configured to control at least driving of the motor based on the calculated moment of inertia to suppress variation in tension of the drawn-out continuous sheet.

Further features of the present invention will become apparent from the following description of exemplary embodiments (with reference to the attached drawings).

DESCRIPTION OF THE EMBODIMENTS

Embodiment 1

Figure 1:
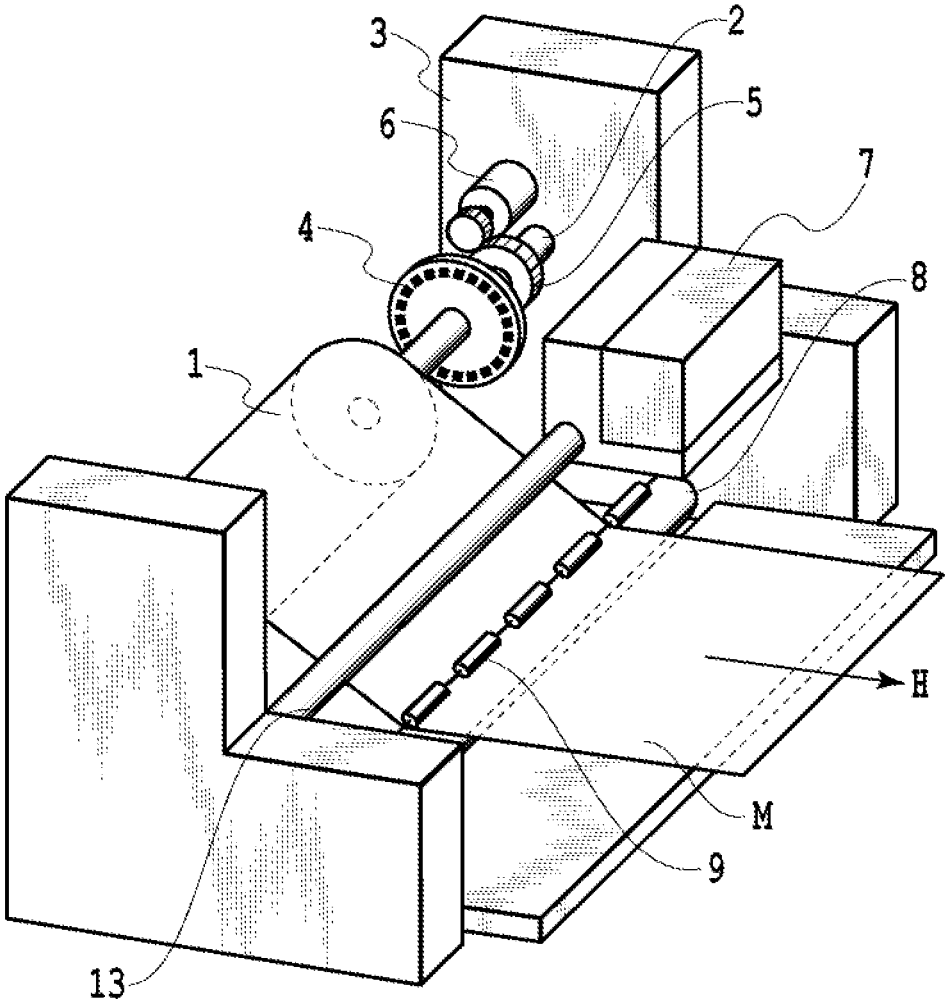
FIG. 1 is a perspective view showing the schematic structure of a printer including a roll sheet conveying apparatus of the present invention.

FIG. 1 is a perspective view showing the schematic structure of a printer which is a roll sheet conveying apparatus of the present invention. A roll sheet 1 is made of a continuous sheet held in a roll and provided in a sheet feeding unit 3 with a spool 2 as a rotational shaft. A sheet M drawn out from the roll sheet 1 is sandwiched between a conveying roller 8 and a pinch roller 9 and conveyed in a direction indicated by an arrow H with the rotation of the roll sheet 1 and the conveying roller 8. The driving force of a sheet feeding motor 6 is transmitted to the spool 2 via a gear 5, thereby rotating the spool 2 and the roll sheet 1. The spool 2 is equipped with a rotary encoder 4 (first encoder) so that the rotation amount of the spool 2 can be detected.

A guide shaft 13 is provided between the roll sheet 1 and the conveying roller 8 to guide and support a printing head 7. The printing head 7 reciprocates along the guide shaft 13 in a direction which crosses the direction H, and prints a predetermined image on the sheet M by ejecting ink during the movement. It is required that during the printing, the surface of the sheet M be smooth, and a distance between the surface of the sheet M and the ejection face of the printing head 7 be constant. Therefore, control is performed so that certain tension is applied between the roll sheet 1 and a roller pair consisting of the conveying roller 8 and the pinch roller 9.

Figure 2:
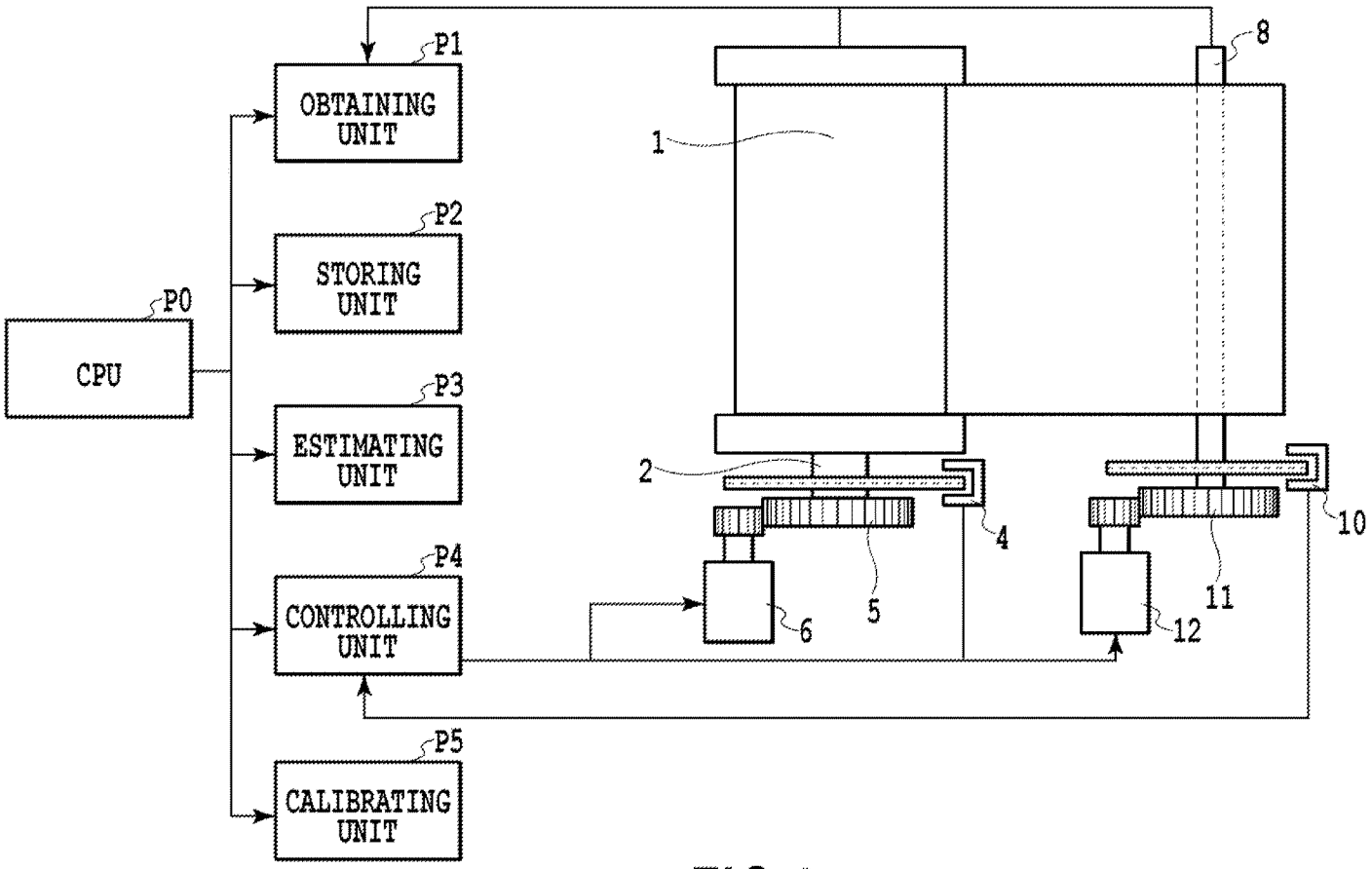
FIG. 2 is a top view showing the structure of the printer and a block diagram illustrating the control configuration of the printer.

FIG. 2 is a top view for explaining a structure relating to the conveying control of the printer and a block diagram showing the control configuration of the printer. The driving force of a conveying motor 12 is transmitted to the conveying roller 8 via a gear 11 to rotate the conveying roller 8. Like the spool 2, the conveying roller 8 is equipped with a rotary encoder 10 (second encoder) so that the rotation of the conveying roller 8 can be detected.

A CPU P0 controls a conveyance driving system for the spool 2 and the conveying roller 8 by using an obtaining unit P1, a storing unit P2, an estimating unit P3, a controlling unit P4, and a calibrating unit P5. The obtaining unit P1 detects output currents of the sheet feeding motor 6 and the conveying motor 12, and obtains friction load torque Tfric0 on the roll sheet 1 based on the output currents. A method for calculating the friction load torque Tfric0 will be described in detail later.

Information which associates the mass m of the roll sheet 1 with the friction load torque Tfric0 is stored in the storing unit P2 as friction load information. The friction load information is calibrated by mounting a calibrating member whose mass is known and measuring friction load torque by the calibrating unit P5 as necessary. The detailed content of the friction load information stored in the storing unit P2 and a method for obtaining the friction load information will be described later.

The CPU P0 refers to the storing unit P2, thereby obtaining the mass m of the roll sheet 1 corresponding to the friction load torque Tfric0 obtained by the obtaining unit P1, and outputs the mass m to the estimating unit P3. The estimating unit P3 estimates the moment of inertia I of the roll sheet 1 from the mass m of the roll sheet 1. The CPU P0 controls the sheet feeding motor 6 and the conveying motor 12 based on the moment of inertia I via the controlling unit P4.

Figure 3:
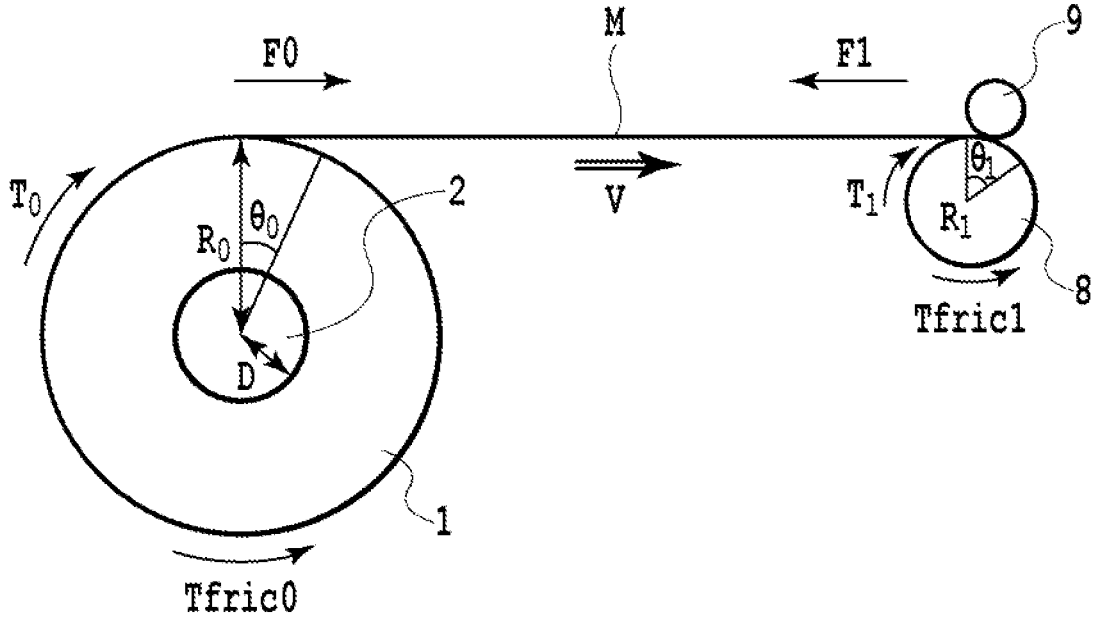
FIG. 3 is a schematic diagram for explaining the dynamic state of a sheet M.

FIG. 3 is a schematic diagram for explaining force applied to the sheet M drawn out from the roll sheet 1 and conveyed by the conveying roller 8. In a case where the sheet M is stopped or conveyed at a constant speed, conveying force F0 for drawing out and conveying the sheet M from the roll sheet 1 and force F1 applied to the conveying roller 8 are in opposite directions and are equal in magnitude F. Accordingly, the following equation is established for the roll sheet 1:

$$F \times R0 + T0 - Tfric0 = 0 \quad \text{(Equation 1)}$$

where R0 is the radius of the roll sheet 1, T0 is the torque of the sheet feeding motor 6, and Tfric0 is the friction load torque on the roll sheet 1.

On the other hand, the following equation is established for the conveying roller 8:

$$-F \times R1 + T1 - Tfric1 = 0 \quad \text{(Equation 2)}$$

where R1 is the radius of the conveying roller 8, T1 is the torque of the conveying motor 12, and Tfric1 is friction load torque on the conveying roller 8.

Figure 4:
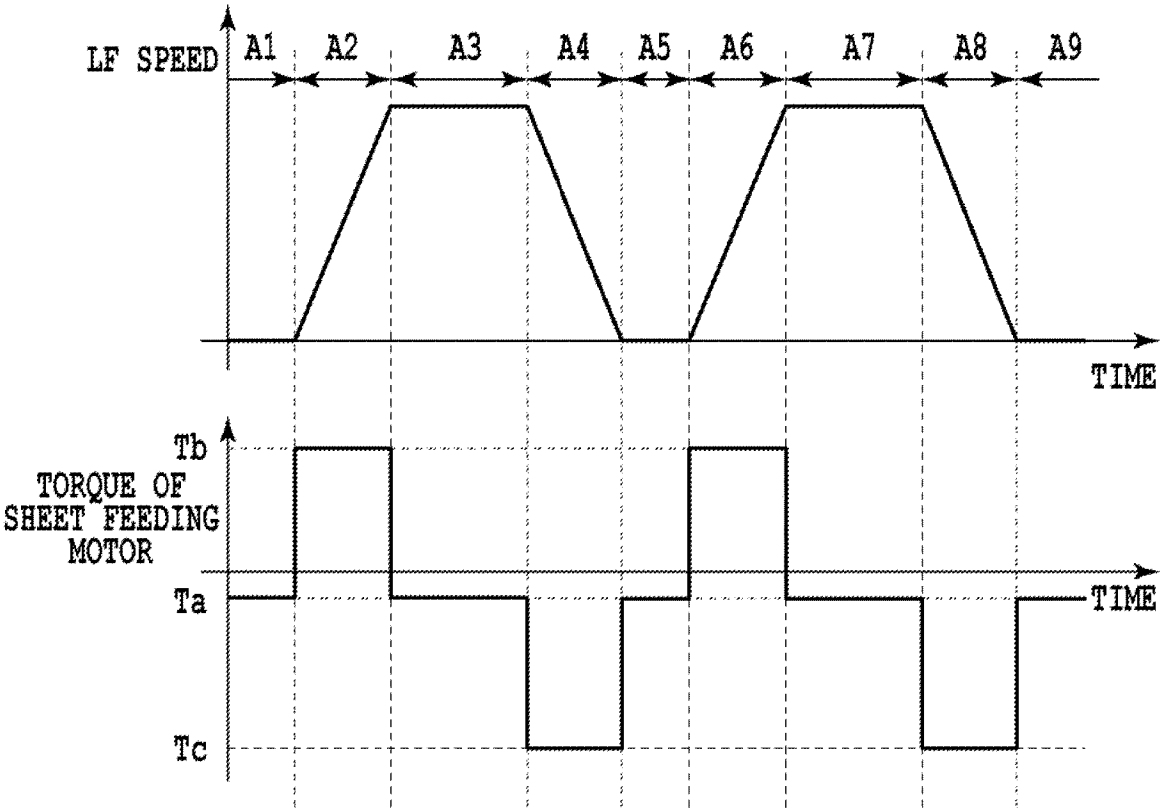
FIG. 4 is a chart showing a temporal relationship between the conveying speed of the sheet M and the torque of a sheet feeding motor.

FIG. 4 is a chart showing a temporal relationship between the conveying speed of the sheet M and the torque of the sheet feeding motor in a case where the printer performs printing. Here, a direction in which the spool 2 is rotated to feed the sheet M in a conveying direction is a forward direction. The printer of the present embodiment is a serial printer which performs the printing scan of the printing head 7 and the conveying of the sheet M alternately to intermittently print an image. Accordingly, while a printing scan is performed, the sheet M is stopped and the speed is zero (A1, A5, and A9). In the present embodiment, Ta is torque necessary for the sheet feeding motor 6 to keep the sheet surface smooth without causing slack at timing that the sheet M is stopped in the above manner. Ta is a negative value.

Further, in order to convey a predetermined amount of the sheet M after a printing scan is completed, the sheet feeding motor 6 is driven with torque Tb during a period A2 (A6) to accelerate the sheet M in the conveying direction H. The torque Tb is obtained according to the equation:

$$Tb = I \times (a1/R0) + Ta$$

where a1 is the acceleration of the sheet M, R0 is the radius of the roll sheet 1, and I is the moment of inertia of the roll sheet 1.

More specifically, the optimum torque Tb in a case where the sheet is accelerated at the acceleration a1 depends on the moment of inertia I of the roll sheet 1.

In a case where the conveying speed of the sheet M reaches a predetermined speed, the torque of the sheet feeding motor 6 is decreased to Ta, and the conveying speed is kept constant during a period A3 (A7).

During a subsequent period A4 (A8), the sheet feeding motor 6 is driven with torque Tc, and the conveying speed of the sheet M is decreased. The torque Tc is obtained according to the equation:

$$Tc = I \times (a2/R0) + Ta$$

where a2 is the acceleration of the sheet M.

More specifically, the optimum torque Tc in a case where the sheet is decelerated at the acceleration a2 also depends on the moment of inertia I of the roll sheet 1.

The optimum torque Tb in a case where the sheet is accelerated at the certain acceleration a1 and the optimum torque Tc in a case where the sheet is decelerated at the acceleration a2 vary depending on the moment of inertia I of the roll sheet 1. Accordingly, in the present embodiment, the moment of inertia is obtained occasionally, and the torque of the sheet feeding motor (and the conveying motor) is adjusted according to the moment of inertia. The sheet feeding motor 6 is sequentially controlled so that the torque of the sheet feeding motor 6 changes from Ta to Tb, then to Ta, then to Tc, then to Ta, then to . . . , whereby the sheet M is conveyed in a predetermined amount at a time intermittently without slack while keeping constant the tension of the sheet M so as to print an image.

With reference to FIG. 3 again, the friction load torque Tfric0 on the roll sheet 1 varies depending on the remaining amount of the roll sheet 1 and the friction load torque Tfric1 on the conveying roller 8 is a value specific to the sheet and does not vary depending on the remaining amount of the roll sheet 1. Accordingly, the friction load torque Tfric1 can be preliminarily measured as a constant.

Further, the radius R0 of the roll sheet 1 can be calculated based on the output of the rotary encoder 4 for the roll sheet 1 and a detected value from the rotary encoder 10 for the conveying roller 8. More specifically, the radius R0 of the roll sheet 1 in a case where a predetermined amount of the sheet M is conveyed can be obtained according to the equation:

$$R0=R1\times\theta1/\theta0 \quad \text{(Equation 3)}$$

where θ0 is a rotation angle detected by the rotary encoder 4 and θ1 is a rotation angle detected by the rotary encoder 10.

Further, it is possible to detect the torque T0 on the roll sheet 1 and the torque T1 on the conveying roller 8 based on the output currents of the sheet feeding motor 6 and the conveying motor 12, respectively. More specifically, for example, there may be preliminarily prepared a table associating the output current EC01 of the sheet feeding motor 6 with the torque T0 and a table associating the output current EC02 of the conveying motor 12 with the torque T1 such as Table 1. In this manner, the torques T0 and T1 can be obtained based on the detected output currents EC01 and EC02 by referring to Table 1.

TABLE 1

| | DETECTED CURRENT VALUE | | | | | |
|---|---|---|---|---|---|---|
| | EC1 | EC2 | EC3 | EC4 | EC5 | EC6 |
| T0 | T01 | T02 | T03 | T04 | T05 | T06 |
| T1 | T11 | T12 | T13 | T14 | T15 | T16 |

Accordingly, the friction load torque Tfric0 on the roll sheet 1 can be obtained based on the detected torques T0 and T1, the constants Tfric1 and R1, and Equations 1 to 3 and can be calculated according to the equation:

$$Tfric0=(T1-Tfric1)\times R0/R1+T0. \quad \text{(Equation 4)}$$

More specifically, the friction load torque Tfric0 at timing that the sheet M is conveyed at a constant speed can be obtained in real time based on the output currents of the sheet feeding motor 6 and the conveying motor 12 and values detected by the rotary encoders 4 and 10. Further, in a case where the friction coefficient of the roll sheet is known, the friction load torque Tfric0 can be associated one-to-one with the mass of the roll sheet 1, and further, the moment of inertia I can also be calculated from time to time request. In the present embodiment, the storing unit P2 previously stores friction load information for deriving the mass m from the friction load torque Tfric0, and the moment of inertia is obtained by using the obtained mass m. Further, the sheet feeding motor and the conveying motor are controlled according to the moment of inertia.

Figure 5A:
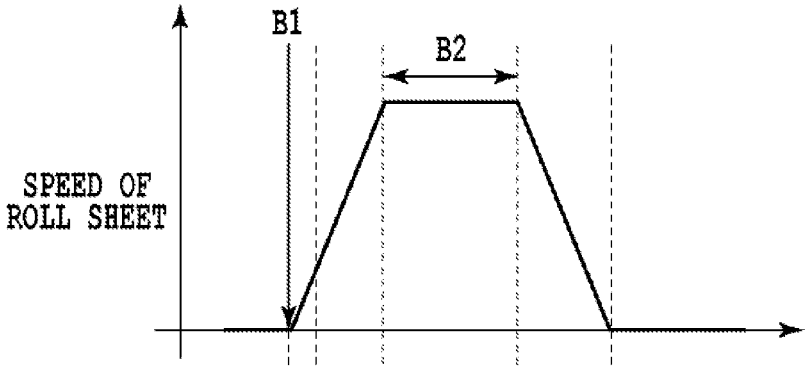
FIGS. 5A and 5B are charts showing a relationship between the conveying speed of the sheet and the torque.
Figure 5B:
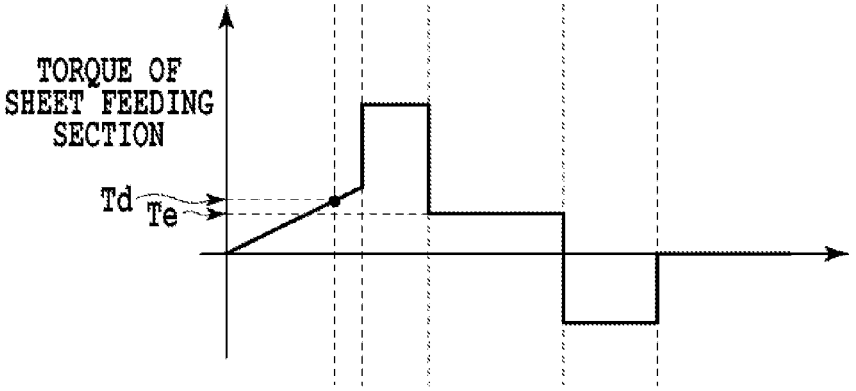

FIGS. 5A and 5B are charts showing a relationship between the conveying speed of the sheet M and the torque T0 of the sheet feeding motor 6 during a sheet feeding operation to obtain the friction load information stored in the storing unit P2. In a case where a sheet feeding command is input, the torque T0 of the sheet feeding motor 6 is increased gradually and the movement of the sheet M is started at timing B1 that the torque T0 of the sheet feeding motor 6 reaches static friction torque Td on the roll sheet 1. The torque T0 at the timing B1 is equal in magnitude to the static friction torque Td on the roll sheet 1. Accordingly, the static friction torque Td can be obtained by detecting the output current of the sheet feeding motor at timing that the rotary encoder 4 detects the starting of the rotation of the roll sheet 1.

Thereafter, during a period B2 in which the sheet M is moved at a constant speed, the torque T0 of the sheet feeding motor is maintained to be equal in magnitude to dynamic friction force Te. Accordingly, dynamic friction torque Te can be obtained by detecting the output current of the sheet feeding motor at timing that the rotary encoder 4 detects the constant-speed rotation of the roll sheet 1.

Figure 6:
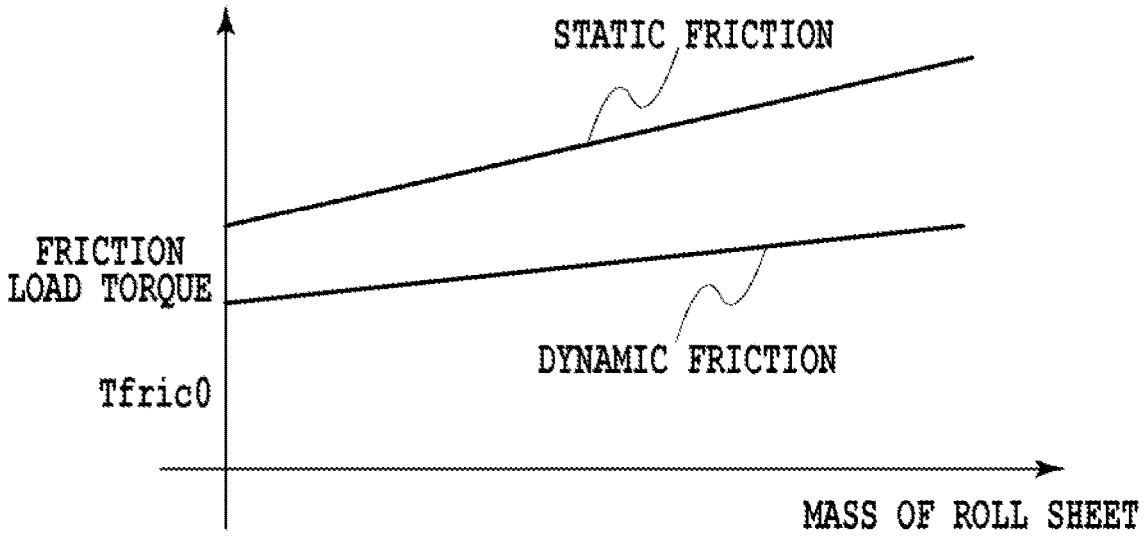
FIG. 6 is a chart showing a relationship between the mass of a roll sheet and friction load torque on the roll sheet.

It is clear that both in the case of static friction and in the case of dynamic friction, the friction load torque increases linearly with the mass m of the roll sheet as shown in FIG. 6. More specifically, the friction load torques Td and Te can be expressed by the following equation using the mass m of the roll sheet and the constants K and C:

$$Td(\text{or } Te)=K\times m+C. \quad \text{(Equation 5)}$$

In the present embodiment, a sheet is fed in a state in which a member is not mounted on the spool and in a state in which a calibration member whose mass is known is used, and the output current of the sheet feeding motor is detected at the timing B1 and during the period B2 to obtain the friction load torques Td and Te for static friction and dynamic friction. The constants K and C are calculated according to the relational equation of Equation 5 by using the calibrating unit P5, and are stored in the storing unit 2 as the friction load information. As long as the friction load information (K and C) is stored in the storing unit 2, even in a case where a roll sheet whose mass is unknown is conveyed, the mass m of the roll sheet 1 can be estimated by using Tfric0 obtained by the obtaining unit P1. More specifically, the mass m can be calculated by calculating backward Equation 5 (m=(Tfric0−C)/K). However, the friction load information stored in the storing unit P2 is not limited to the above constants K and C. There may be prepared a table such as Table 2 associating the mass m one-to-one with the friction load torque Tfric0 obtained from the equation Tfric0=K×m+C.

TABLE 2

| | m | | | | | | |
|---|---|---|---|---|---|---|---|
| | m1 | m2 | m3 | m4 | m5 | m6 | m7 |
| Tfric0 | Tf1 | Tf2 | Tf3 | Tf4 | Tf5 | Tf6 | Tf7 |

Incidentally, the friction load information may be calibrated periodically or as necessary by using the calibration member, and its timing is not limited.

Figure 7A:
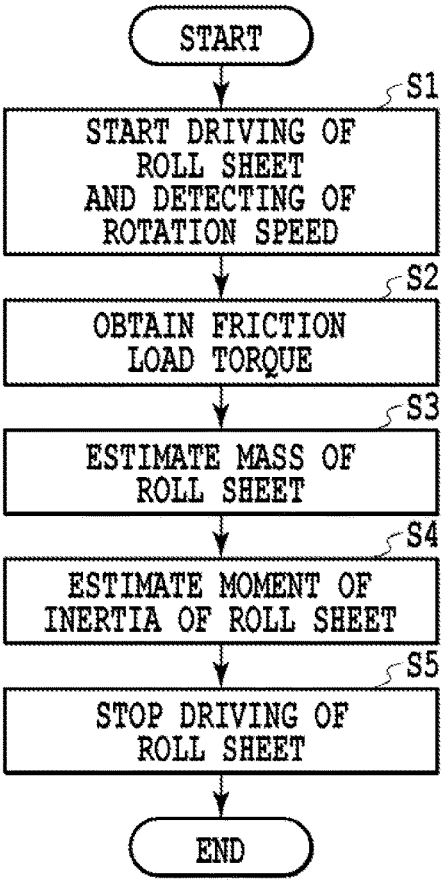
FIGS. 7A and 7B are flowcharts showing a process for controlling conveyance driving.
Figure 7B:
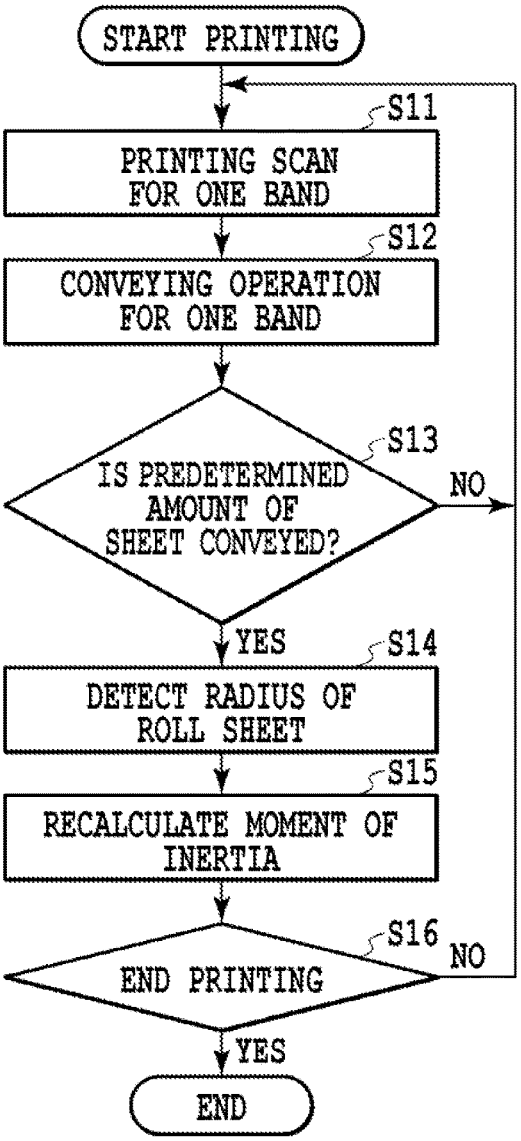

FIGS. 7A and 7B are flowcharts for explaining a method and process for controlling the driving of the sheet feeding motor 6 and the conveying motor 11 during printing according to the present embodiment. In the present embodiment, in a sheet feeding operation which is performed during an early stage of a printing operation, the friction load torque Tfric0 is obtained from the output currents of the sheet feeding motor 6 and the conveying motor 9, and the moment of inertia I of the roll sheet 1 is estimated from the corresponding mass m. On the other hand, in an actual printing operation in which the roll sheet is consumed gradually, the mass m is calculated based on the radius R0 of the roll sheet obtained from the output values of the rotary encoders 4 and 10 and the moment of inertia I' is recalculated. The driving of the sheet feeding motor 6 and the conveying motor 11 is controlled appropriately based on the default moment of inertia I obtained in this manner and the moment of inertia I' obtained by recalculation.

FIG. 7A is the flowchart for explaining a process in which the CPU P0 obtains the default moment of inertia I of the roll sheet 1 during sheet feeding. When this process is started, the CPU P0 drives the sheet feeding motor 6 and the conveying motor 9, and starts the rotation and conveyance of the roll sheet 1. Further, CPU P0 starts to detect a rotation speed by using the rotary encoder 4 (step S1).

After it is confirmed that the roll sheet 1 rotates at a constant speed, the process proceeds to step S2. The CPU P0 obtains the friction load torque Tfric0 based on the above-described Equations 3 and 4 by using the rotation angles θ0 and θ1 obtained by the rotary encoders 4 and 10. Further, in step S3, the mass m of the roll sheet 1 corresponding to the friction load torque Tfric0 obtained in step S2 is obtained by referring to the friction load information stored in the storing unit P2.

In subsequent step S4, the CPU P0 estimates the moment of inertia I of the roll sheet 1. The roll sheet 1 rotating about the spool 2 as an axis is a hollow cylinder. Accordingly, the moment of inertia I is obtained according to the equation:

$$I=m\times(R0^2+D^2)/2 \quad \text{(Equation 6)}$$

where D is the radius of the spool 2.

The radius D of the spool 2 is a constant, and may be measured beforehand, and a mechanism capable of detecting the diameter 2D may be prepared. After the moment of inertia I is obtained in step S4, the CPU P0 temporarily stores this value I as the default moment of inertia I and controls the driving torques of the sheet feeding motor 6 and the conveying motor 12 according to the moment of inertia I. In this manner, the sheet M is conveyed in a state in which predetermined tension is maintained.

In a case where the sheet M is conveyed to a predetermined position, the CPU P0 stops the driving of the sheet feeding motor 6 and the conveying motor 12 (step S5), and the process ends.

FIG. 7B is the flowchart for explaining a process for recalculating the moment of inertia of the roll sheet 1 and simultaneously performing appropriate driving control in the actual printing operation after sheet feeding.

First, in step S11, the CPU P0 performs a printing scan of the printing head 7 according to input image data, and in step S12, the CPU P0 performs a conveying operation for the printing scan. On this occasion, the torques of the sheet feeding motor 6 and the conveying motor 12 are adjusted based on the latest moment of inertia I stored so that the sheet M held between the roll sheet 1 and the conveying roller 8 is conveyed at a predetermined acceleration or deceleration while predetermined tension is maintained.

The printing scan in step S11 and the conveying operation in step S12 are repeated until in step S13, it is determined that the amount of the conveyed sheet M reaches a predetermined amount.

In a case where the amount of the conveyed sheet reaches the predetermined amount, the current radius R0' of the roll sheet 1 is obtained in step S14. More specifically, the rotary encoders 4 and 10 detect the rotation angle θ0 of the roll sheet 1 and the rotation angle θ1 of the conveying roller 8, and calculate the current radius R0' of the roll sheet 1 according to Equation 3.

In subsequent step S15, the CPU P0 estimates the current mass m' of the roll sheet 1 from the radius R0' obtained in step S14 and the radius R0 and the mass m of the roll sheet 1 at the time of sheet feeding as explained with reference to FIG. 7A. More specifically, the current mass m' can be calculated according to the equation: $m'=m\times(R0'^2-D^2)/(R0^2-D^2)$. The current moment of inertia I' of the roll sheet 1 is calculated according to Equation 6 using the obtained mass m', and the torques of the sheet feeding motor 6 and the conveying motor 12 are adjusted based on the updated moment of inertia I'.

In step S16, it is determined whether or not printing scans for all image data are completed, and in a case where the printing scans are not completed, the process returns to S11, and a printing scan is performed based on next image data. On the other hand, in a case where it is determined that the printing scans for all the image data are completed in step S15, the process ends.

In the present embodiment explained above, the relationship between the friction load torque and the mass is previously stored in the storing unit, whereby the moment of inertia of the roll sheet can be detected at appropriate timing during printing. As a result, the optimum tension of the sheet M to be conveyed can be maintained by appropriately adjusting the driving control of the sheet feeding motor and the conveying motor without performing a special identifying operation.

Incidentally, in the embodiment, explanation is made on obtaining the default moment of inertia I at the time of the sheet feeding operation immediately after starting the printing operation. However, as long as the roll sheet rotates at a constant speed, even in a case where a sheet feeding operation is not performed, the moment of inertia can be obtained at various timings.

Further, in the above embodiment, the encoders 4 and 10 obtain the rotation angles of the roll sheet 1 and the conveying roller 8, but the present invention is not limited to this feature. Two speed sensors may be provided in place of the encoders 4 and 10. Even in this feature, physical quantities necessary for the processing in the present invention are obtained, and advantageous results similar to those of the embodiment can be achieved.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional application of U.S. application Ser. No. 14/172,086, filed on Feb. 4, 2014, and which claims the benefit of Japanese Patent Application No. 2013-033411, filed Feb. 22, 2013, which are both hereby incorporated by reference in their entireties herein.

What is claimed is:

1. A print apparatus comprising:

a supporting unit configured to support a roll sheet that is made up of a continuous sheet wound into a roll;

a feeding motor configured to rotate the roll sheet supported by the supporting unit;

a first detecting unit configured to detect a rotational amount of the roll sheet supported by the supporting unit;

a conveying roller configured to convey a sheet supplied from the supporting unit;

a conveying motor configured to drive the conveying roller;

a second detecting unit configured to detect a rotational amount of the conveying roller;

a printing head configured to print on the sheet conveyed by the conveying roller;

a control unit configured to control printing of an image on the sheet by repeating a conveying operation in which the sheet is conveyed by the conveying roller for a specified distance and a printing operation in which the printing head prints on the sheet while moving, the feeding motor being driven with a predetermined driving torque in the conveying operation;

a calculation unit configured to calculate a radius of the roll sheet based on the rotational amount detected by the first detecting unit and the rotational amount detected by the second detecting unit at the timing of conveying the sheet for a predetermined distance;

an obtaining unit configured to obtain a moment of inertia of the roll sheet based on the radius of the roll sheet calculated by the calculation unit; and a determination unit configured to determine the predetermined driving torque for driving the feeding motor in the conveying operation based on the moment of inertia of the roll sheet obtained by the obtaining unit.

2. The print apparatus according to claim 1, wherein the obtaining unit obtains the moment of inertia of the roll sheet by calculation using a mass and the radius of the roll sheet supported by the supporting unit.

3. The print apparatus according to claim 2, wherein the control unit estimates a torque T for rotating the roll sheet by calculation using a driving current of the feeding motor, a driving current of the conveying motor, the rotational amount detected by the first detecting unit, and the rotational amount detected by the second detecting unit, and obtains the mass of the roll sheet by the estimated torque T.

4. The print apparatus according to claim 1, wherein the printing head is mounted on a carriage for performing serial printing, and wherein the determination unit determines the predetermined driving torque of the feeding motor for each of a zero-speed period, an acceleration period, a constant-speed period, and a deceleration period in the conveying operation of the serial printing.

5. The print apparatus according to claim 4, wherein the determination unit determines the driving torque of a plus value at the acceleration period and determines the driving torque of a minus value at the zero-speed period, the constant-speed period, and the deceleration period.

6. The print apparatus according to claim 5, wherein each of the driving torque for the acceleration period and the deceleration period is determined in accordance with consumption of the roll sheet by printing, whereby a tension of the sheet between the roll sheet and the conveying roller is appropriately maintained regardless of the sheet consumption.

* * * * *